United States Patent [19]

West

[11] Patent Number: 5,067,925

[45] Date of Patent: Nov. 26, 1991

[54] INFANTS'S TOY

[76] Inventor: Atwell G. West, 5521 Jester Dr., Garland, Tex. 75044

[21] Appl. No.: 608,480

[22] Filed: Nov. 2, 1990

[51] Int. Cl.[5] ..... A63H 33/28

[52] U.S. Cl. ..... 446/397; 446/369; 446/71

[58] Field of Search ..... 446/71, 72, 81, 227, 446/369, 385, 486

[56] References Cited

U.S. PATENT DOCUMENTS

| | | | |
|---|---|---|---|
| 1,659,720 | 2/1928 | Cate | 446/369 |
| 3,977,121 | 8/1976 | Goldfarb et al. | 446/369 |
| 4,378,391 | 3/1983 | Allen | 446/81 X |
| 4,565,376 | 1/1986 | Croll | 446/369 X |
| 4,648,851 | 3/1987 | Rosenberg | 446/369 X |
| 4,911,671 | 3/1990 | Rogers | 446/397 X |
| 4,944,363 | 7/1990 | Osher et al. | 446/369 X |

FOREIGN PATENT DOCUMENTS

| | | | |
|---|---|---|---|
| 265062 | 2/1927 | United Kingdom | 446/369 |

*Primary Examiner*—Robert A. Hafer
*Assistant Examiner*—Sam Rimell
*Attorney, Agent, or Firm*—Jones, Day, Reavis & Pogue

[57] ABSTRACT

An infant's toy that is both visually and audibly attractive to an infant and which has a soft inner layer of any desired shape formed of a foam rubber material, a pliable sound-generating layer including a sound-generating means covering at least a portion of the soft inner layer for causing a noise to attract the infant when handled by the infant, and a cloth outer layer entirely covering the soft inner layer and the pliable layer including the sound-generating means to form a unitary infant's toy. The outer layer may have brightly colored designs thereon to visually attract the infant.

12 Claims, 1 Drawing Sheet

INFANTS'S TOY

FIELD OF THE INVENTION

The present invention relates to an infant's toy and in particular to an infant's toy that is visually attractive to the infant, safe for the infant to handle, and audibly attractive because of a crackling sound that holds the infant's interest.

BACKGROUND OF THE INVENTION

There are a multitude of infant toys and playthings in existence which range from cloth items such as nerf balls, toys that make noise when squeezed to toys that move or otherwise attract the infant's attention.

In all of these cases, there is some problem for the infant. In some cases, the toy contains sharp edges which might harm the infant. In other cases, the item is not attractive and thus does not attract the baby's attention. Finally, the articles are not of sufficient interest to the infant to hold the infant's attention for an extended period of time.

The present invention relates to an infant's toy which is not only soft, pliable and safe for the baby to handle, but also has brightly colored coverings and various shapes to attract the baby's attention visually. It is also formed so as to make a pleasant intriguing sound to hold the baby's attention when the baby handles the toy. The toy is constructed with a soft inner layer formed of a material such a foam rubber. The inner material may have various shapes, such as rectangular, triangular, trapezoidal and the like. The soft inner layer of foam rubber may be at least partially covered with a pliable sound-generating material to cause a noise to attract the infant's attention when the toy is handled. The pliable sound-generating layer may be, for example, a plastic material having air pockets therein that cause a crackling sound when squeezed. Such plastic material is well known in the art and is used in many cases for packing in cartons to protect products being transported in the cartons. The pliable sound-generating layer may cover all or at least a portion of the soft inner layer. Surrounding the soft inner layer and the sound-generating layer is a flexible plastic layer that is watertight and not only forms a unitary device, but also allows the infant's toy to be washable. A cloth outer layer covers the unitary infant toy. The cloth outer layer may be a cotton or terrycloth layer that has brightly colored designs thereon to attract the infant's attention and is also washable.

Thus, it is an object of the present invention to provide an infant's toy that is not only visually attractive to the infant, but that also emits a noise that audibly attracts the infant when handled by the infant. Thus, the present invention provides an infant's toy that is attractive both visually and audibly to the infant.

It is also an object of the present invention to provide an infant's toy that is formed of soft materials such as foam rubber, pliable plastic and cotton cloth to form a toy that is safe for the infant to handle.

It is still another object of the present invention to provide an infant's toy that causes a crackling sound when handled by the infant.

It is yet another object of the present invention to provide an infant's toy that is safe to handle, attractive to look at, creates an attractive audible sound and is formed in any desired three-dimensional shape.

It is another object of the present invention to provide a unitary infant's toy that is washable so that the toy can be kept in a sanitary condition for the infant's use.

SUMMARY OF THE INVENTION

The present invention relates to an infant's toy comprising a soft inner layer, a pliable sound-generating layer covering a least a portion of said soft inner layer for causing a noise to attract infants when handled by the infant, and a cloth outer layer entirely covering the inner layer and the sound-generating layer to form a unitary infant's toy.

The invention also relates to a method of constructing an infant's toy comprising the steps of forming a soft inner layer, covering a least a portion of the soft inner layer with a pliable sound-generating layer, and entirely covering the soft inner and the pliable sound-generating layer with a cloth outer layer to form a unitary infant's toy.

BRIEF DESCRIPTION OF THE DRAWINGS

These and other objects of the present invention will be more fully disclosed in conjunction with the following detailed description of the drawings in which.

DETAILED DESCRIPTION OF THE DRAWINGS

Figure 1:
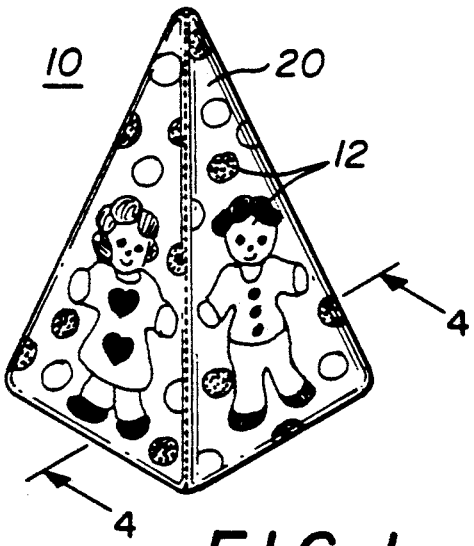
FIG. 1 is a top view of an infant's toy of the present invention that has pyramid shape.
Figure 2:
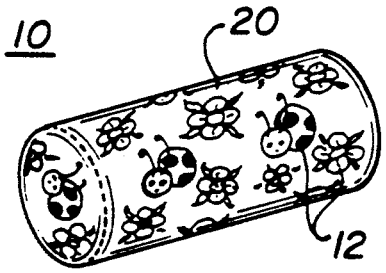
FIG. 2 is a cylindrical shaped infant's toy of the present invention.
Figure 3:
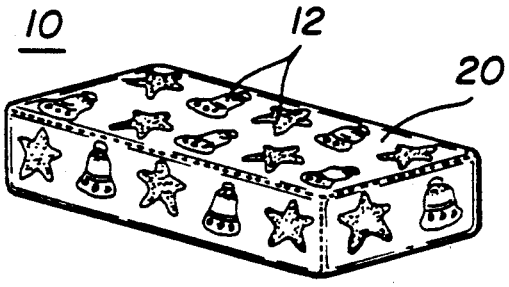
FIG. 3 is a trapezoidal shaped infant's toy of the present invention.

FIG. 1 is a top view of a pyramid shaped infant's toy of the present invention. It is generally designated by the numeral 10 and has thereon a number of printed designs 12 which, in the preferred embodiment, will be brightly colored to attract the baby's attention. Other examples of the possible shapes of the infant's toy are illustrated in FIG. 2 as a cylindrical toy 10 and in FIG. 3 as a trapezoidal shaped toy 10. As in FIG. 1, each of the infant's toys in FIGS. 2 and 3 have brightly colored designs 12 thereon in any desired shape and color to attract the baby's attention visually.

Figure 4:
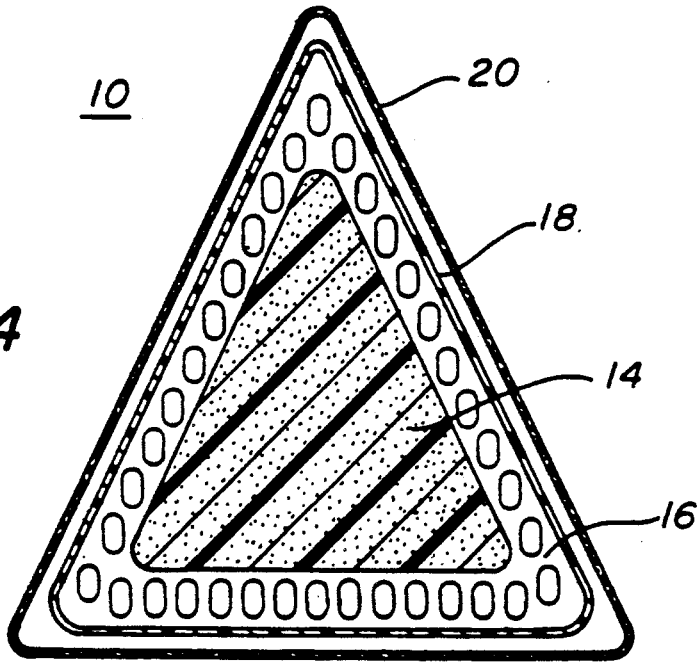
FIG. 4 is a cross-sectional view of the pyramid shaped infant's toy taken along lines 4—4 of FIG. 1.

FIG. 4 is a cross-sectional view of the pyramid shaped infant's toy shown in FIG. 1. It has a soft inner layer 14 which may be of foam rubber. The foam rubber inner layer 14 has any desired shape and is shown in FIG. 4 in cross section as having a pyramid shape that is triangular in cross section. A pliable sound-generating layer 16 covers at least a portion of the soft foam rubber inner layer 14 for causing noise to attract the infant when handled by the infant. This pliable sound-generating layer may be formed in any well-known manner such as a well-known plastic material having air bubbles therein that cause a crackling noise when squeezed. This pliable sound-generating layer may be of the type used to package objects in cartons to protect them during shipment. Any such type of pliable sound-generating material may be used, provided that it makes a interesting noise and provided that it is soft and pliable so as not to be dangerous to the infant. If desired, a layer 18 of very thin plastic, such as that commonly used as shopping bags in supermarkets, may be placed over the entire pliable sound-generating layer and the soft inner layer and heat sealed to form a unitary toy. Such layer of thin resilient plastic 18 would keep the pliable sound-generating layer and soft inner layer in abutting relationship so that one could not move with respect to the other. The heat sealed plastic layer 18 is waterproof and protects the soft inner layer and the pliable sound-generating layer from moisture. Finally, a brightly colored outer layer 20 formed of cotton cloth or a cloth such as terrycloth may be placed over the entire unit and sewn together so as to form a unitary infant's toy. Because of the heat sealed plastic layer 18, the inside of the toy is waterproof and thus the entire toy may be washed. This is an important concept because of the germs that could contaminate the outer layer 20 by a child who is ill. By washing the toy, transfer of the germs can be eliminated.

Thus, the toy as illustrated in FIGS. 1–4 is formed of a soft material that will not harm the infant, has a brightly colored outer surface to visually attract the child, has a soft sponge rubber inner core to keep the shape of the toy and allow it to be squeezed by the child and yet returned to its original shape, and has a middle layer that is formed of a sound-generating material such as plastic with air pockets that create a crackling noise when squeezed by the child. Thus, the toy provides both a visual and audible attraction to the child and holds the child's attention when the child is playing with it because of the noise that it generates.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. An amusement device for an infant comprising:

a soft inner layer that is squeezable and retains its shape after being released;

a pliable layer including sound-generating means covering a major portion of said soft inner layer for causing a noise to attract an infant when handled by the infant; and a cloth outer layer entirely covering said soft inner layer and said pliable layer including said sound-generating means to form a unitary infant's toy.

2. An amusement device as in claim 1 wherein said soft inner layer is a foam rubber body member having a three-dimensional shape.

3. An amusement device as in claim 2 wherein said pliable layer including said sound-generating means is a plastic material having air pockets therein that cause a crackling sound when squeezed.

4. An amusement device as in claim 3 further comprising colored designs on said outer cloth layer for attracting the infant's attention visually.

5. An amusement device as in claim 2 wherein the soft foam rubber inner body is formed in a three-dimensional shape.

6. An amusement device as in claim 1 further comprising:

a pliable plastic layer entirely covering said soft inner layer and said pliable a layer having said sound-generating means in a watertight relationship; and said cloth outer layer entirely covering said thin plastic layer, said amusement device being washable because of said thin plastic layer.

7. A method of constructing an infant's toy comprising the steps of:

forming a soft inner layer that is squeezable and retains its shape after being released;

covering a major portion of the soft inner layer with a pliable layer including sound-generating means to audibly attract the infant's attention; and entirely covering the soft inner layer and the pliable layer including said sound-generating means with a cloth outer layer to form a unitary infant's toy.

8. A method as in claim 7 further comprising the step of forming the soft inner layer with a foam rubber body member.

9. A method as in claim 7 further comprising the step of forming said pliable layer including the sound-generating means from a plastic material having air pockets therein that cause a crackling sound when squeezed.

10. A method as in claim 9 further comprising the step of printing colorful designs on said outer cloth layer for attracting the infant's attention visually.

11. A method as in claim 8 further comprising the step of forming the soft foam rubber inner body in a three-dimensional shape.

12. A method as in claim 7 further comprising the steps of:

entirely covering said soft inner core and said pliable layer including the sound-generating means with a flexible plastic layer in a watertight relationship so that the infant's toy is washable; and covering the flexible plastic layer with said cloth outer layer.

* * * * *